US007704152B1

(12) United States Patent
Thorson

(10) Patent No.: US 7,704,152 B1
(45) Date of Patent: Apr. 27, 2010

(54) NO-SLIDE PIN SPOT

(75) Inventor: Scott J. Thorson, Des Moines, IA (US)

(73) Assignee: Pinsetter Parts Plus, LLC, Mosinee, WI (US)

( * ) Notice: Subject to any disclaimer, the term of this patent is extended or adjusted under 35 U.S.C. 154(b) by 161 days.

(21) Appl. No.: 11/779,613

(22) Filed: Jul. 18, 2007

Related U.S. Application Data

(60) Provisional application No. 60/827,339, filed on Sep. 28, 2006.

(51) Int. Cl.
*A63D 5/06* (2006.01)

(52) U.S. Cl. ..... 473/54; 473/102

(58) Field of Classification Search ..... 473/54, 473/102, 115
See application file for complete search history.

(56) References Cited

U.S. PATENT DOCUMENTS 1,552,203 A * 9/1925 Bishop ..... 473/102
4,205,843 A 6/1980 Murrey, Sr.
4,795,152 A 1/1989 Suiter

OTHER PUBLICATIONS http://www.bowltech.com/content/btubb/ubbthreads.php?ubb=showflat&Number=221190#Post221190, Bowl-Tech forum website, discussion of no slide pin spots, Apr. 2007.*
http://www.nonslipbath.co.uk/index.htm, Website for Non Slip Bath Safety Circles, Jul. 2006.*
https://www.bindingsource.com/pdf/Bumpons%20Brochure%202.pdf, Quiet, Cushion and Protect Whatever You Need, 3M Bumpon Protective Products brochure, 2007.*

* cited by examiner

*Primary Examiner*—William M Pierce
(74) *Attorney, Agent, or Firm*—Boyle Fredrickson, S.C.

(57) ABSTRACT

An easily installed frictional bowling pin spot and a method of installing frictional pin spots on the pin deck of a bowling lane are disclosed. The preferred frictional pin spot is preferably a thin, circular polyurethane piece having a high coefficient of friction and packed with a pressure-sensitive adhesive. The pin spot increases the friction between a bowling pin and the pin deck thereby decreasing the likelihood of bowling pins hit by a ball or other pin sliding out of position instead of being knocked over.

10 Claims, 2 Drawing Sheets

NO-SLIDE PIN SPOT

CROSS-REFERENCE TO RELATED APPLICATIONS

This application claims priority under 35 U.S.C. §119 from U.S. Provisional Patent Application Ser. No. 60/827,339, filed on Sep. 28, 2006, and herein incorporated by reference in its entirety.

BACKGROUND OF THE INVENTION

1. Field of the Invention

The invention relates to bowling lanes and, more particularly, to improvements in pin spots that are placed on a bowling lane pin deck.

2. Discussion of the Related Art

Until the middle of the twentieth century, bowling centers employed pin-boys, also known as pinsetters or pinspotters, to manually reset bowling pins in their correct position as indicated by pin spots, clear fallen pins and return bowling balls to the players. The bowling pins were something manually placed on pin spots, painted on the pin deck, that were slightly larger than the diameter of the bottom of the pins. The constant, repetitive placing of bowling pins on the pin spots caused them to wear unevenly in comparison to the surrounding surfaces of the bowling lane. A number of removable and/or replaceable pin spot inserts were developed that were resistant to wear and imbedded into the bowling lane. These inserts could be installed in recesses in the pin decks and removed when worn or damaged rather than resurfacing the entire pin deck. Examples of these devices can be found in U.S. Pat. Nos. 715,215 entitled Bowling Alley Pin Spot, 1,020,646 entitled Pin Spot for Bowling Alleys and 2,469,219 entitled Pin Spot Marker for Bowling Alleys.

By about the 1930s, the automatic pinsetter had been invented, which largely did away with the need for employing pin-boys and also for replaceable pin spots. The automatic pinsetters were able to consistently place bowling pins on the pin deck with a minimal amount of force against the pin deck thereby reducing uneven wear on the pin deck. Nevertheless, pin spots have remained a part of bowling lanes, although presently they are simply a darkened portion of the bowling lane material and not made from a separate material or even painted on. The primary purpose of painted pin spots is to facilitate the inspection of automatic pinsetters. Since the pin spots have a slightly larger diameter than the bottom of a standard bowling pin, a quick visual check can be made to determine if any pin is set in such a way that the outer edge of its corresponding pin spot is not visible.

Further advances in pin deck construction included the use of high pressure laminate material adhesively bound to a wooden base or a strictly synthetic material, both having an external surface with the appearance of finished wood. Improvements have also been made in lane surface maintenance, care and conditioning. Many modern bowling centers employ state-of-the-art lane finishing equipment, such as that described in U.S. Pat. No. 6,923,863, entitled Apparatus and Method for Bowling Lane Maintenance. Special lane conditioners and oils have been developed to exact higher scores and are applied with precision and uniformity. Furthermore, most bowling centers have clean environments, knowledgeable employees and strict maintenance schedules.

For the most part, this improved lane conditioning has resulted in higher scores and has been greeted with enthusiasm by the bowling world. However, one problem, the standing out-of-range pin, has risen significantly due to the increased use of lane conditioners and oils. The out-of-range pin can cause equipment problems, especially to automatic pinsetters, as well as cause bowler frustration over having the pin slide and not being knocked over. The out-of-range pin typically occurs when a bowling pin slides, and remains standing, instead of falling when struck by a bowling ball or another pin. As a result, the pin is not counted as being knocked down, even though the automatic pinsetter strikes the pin on the next cycle and knocks it down. Out of range pin sliding is especially problematic on lanes with pin decks made of synthetic materials because these decks are very smooth and flat. Pins are therefore more likely to slide on them than wood decks, which have some degree of roughness even if they are very highly polished.

The increase in this pin sliding action, rather than falling action, can be attributable to a number of factors. The most common cause of out-of-range pins is the presence of conditioner or oil on the pin deck. This can be caused by conditioner or oil "carry down" occurring when a bowling ball transfers a streak of oil or conditioner from the lane to the pin deck. Another cause can be a lane cleaning system that is not functioning properly, thereby leaving oil residue on the pin deck. Even a properly functioning cleaning system may not use enough cleaning solution to properly clean the pin deck. A final cause of out-of-range pins is that when the wood base of a bowling pin wears down and exposes a hard plastic ring that is commonly placed in a notch at the bottom of the pin. The ring then makes contact with the pin deck. Since the plastic ring has less friction than wood, the likelihood of sliding is increased.

Therefore, the need has arisen for a solution to reduce out-of-range pins that is easy to use, simple to install and remove, and has a smaller footprint than the previous solutions.

SUMMARY OF THE INVENTION

In accordance with a first aspect of the invention, the above-mentioned needs are met through the use of a bowling pin spotting article, i.e., an anti-skid pin spot, that can be quickly and easily installed and removed.

Preferably, the pin spot is comprised of a plastic film material having a dynamic coefficient of friction greater than 1.0 with an adhesive applied to the bottom of the piece. The pin spots may be sold with a release backing provided as a sheet or roll. The pin spot can be releasably adhered to a bowling lane pin deck to provide a high friction support surface for one or more bowling pins. In a preferred embodiment, the pin spot has a thickness of 1/32 inch and is generally circular-shaped with a diameter of 3⅛ inches. The preferred pin spot is made of a transparent, impact-resistant and wear-resistant material. In one preferred embodiment, the pin spot is made of a clear polyurethane material with an acrylic-based pressure sensitive adhesive applied to one side. After installation, the pin spot can be quickly and easily removed from a bowling lane pin deck and replaced with a new pin spot. The preferred adhesive and pin spot are not degraded by detergents, bleach or other cleaners typically used to clean bowling lanes.

One aspect of the present invention includes a pin deck incorporating a plurality of no-skid pin spots as described above arranged in a pre-determined pattern matching the location of at least one bowling pin. The pattern can be that used for ten-pin bowling, nine-pin bowling or even five-pin bowling.

In accordance with still another embodiment of the invention, a method is provided for applying frictional material pieces to bowling pin decks as pin spots to reduce out-of-range bowling pins. The method comprises the steps of i) providing a frictional material piece suitably shaped as a pin spot, ii) cleaning the surface of a pin deck with a non-residue leaving agent and drying the surface, and iii) adhering the piece of frictional material directly to the pin deck surface in a desired location.

These and other features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENT

Figure 3:
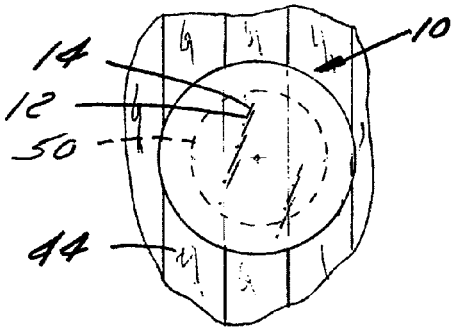
FIG. 3 is a fragmentary top plan view of a portion of the pin deck.
Figure 4:
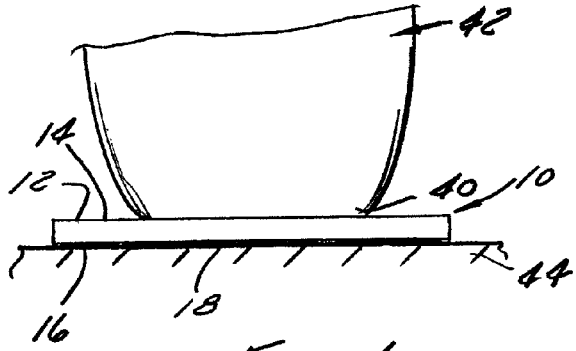
FIG. 4 is a partial sectional view taken along 4-4 of FIG. 2.
Figure 1:
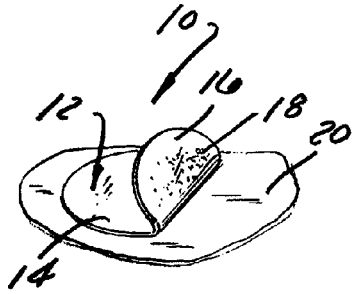
FIG. 1 is a perspective view of a no-slide pin spot constructed in accordance with a preferred embodiment of the invention removably adhered to a release backing.

Referring to FIGS. 1 to 4, there is shown a preferred construction, application and function of a self-adhesive no-slide pin spot article constructed in accordance with an embodiment of the present invention. In FIG. 4, the thickness of the pin spot is exaggerated for clarity of illustration.

The no-slide pin spot, i.e., a bowling pin spotting article designated generally as 10, comprises a piece of frictional material 12 having a top, bowling pin-contacting surface 14 and a bottom surface 16, preferably having a pressure-sensitive adhesive 18 applied thereon. A release liner or backing 20, coated on one surface with a release agent (not shown), is provided so as to permit the pin spot 10 to be readily transported and stored yet easily peeled off of the backing 20 without disturbing the adhesive 18. It should be noted, however, that the pre-applied adhesive 18 and release backing 20 are not essential. An adhesive could instead be applied to the bottom surface 16 of the frictional material piece 12 on-site using a brush or the like.

The pin spots 10 can be any desired shape and size but preferably are sized and shaped to support at least a significant portion of the base 40 of a standard ten-pin bowling pin 42 with a reasonable margin of tolerance. For example, a standard bowling pin base has a diameter of 2¼." For the standard pin 42, the preferred pin spot 10 is therefore circular in shape and has a diameter of 2" to 3½", though even more preferably has a diameter of 3" to 3¼", and most preferably have a diameter of 3⅛". The material piece 12 should have a thickness of less than ¼" and preferably no more than about 1/32".

The pin spots 10 are preferably formed from a material 12 that is relatively flexible, relatively resistant to sliding or abrasion from a bowling ball rolling thereacross, and has a sufficiently high coefficient of friction to, at a minimum, inhibit, and optimally prevent a bowling pin 42 placed thereon from sliding upon contact by a bowling ball or another bowling pin 42. The adhesive 18 and material 12 also preferably is not be degraded by detergents, bleach or other cleaners typically used to clean bowling lanes. After a typical application, the pin spot 10 should be capable of being peeled from the pin deck 44 in one or a few pieces with little to no adhesive 18 remaining on the pin deck 44. Any remaining adhesive 18 may be cleaned off with a mild solvent, such as Chlorinate Solvent 008, a mild detergent in water, or isopropyl alcohol. In the preferred embodiment, the material pieces 12 are die-cut or otherwise formed from a transparent polyurethane sheet rollstock product produced by 3M under the Bumpon™ Protective Products line. The preferred 3M 5600 series rollstock includes an acrylic-based adhesive (comprising the aforementioned adhesive 18) that adheres especially well to high energy plastics such as polycarbonate, Formica®, and synthetic materials used to produce bowling lanes. The rollstock, and pieces 12 cut therefrom, has a dynamic coefficient of friction, $\mu_k$, greater than 1 and is highly resistant to impact and shear, i.e., it doesn't slide, upon contact with a bowling ball or bowling pin 42, and is also highly resistant from wear and abrasion.

In use, at least one pin spot 10 is adhered to a pre-determined location on the pin deck 44 of a bowling lane 46. The pin spot 10 location is preferably generally a spot where a bowling pin 44 is set by an automatic pinsetter. Hence, for a typical U.S. ten-pin bowling pattern, a total of ten pin spots 10 may be applied in the pattern 48 shown in FIG. 2. However, if desired, a pin spot can be omitted from the front and center or so called "ten pin" spot 50 because it is unlikely to experience out of range movement during normal play. The pin spots 10 are preferably applied using the following procedure.

Referring to FIGS. 1-5, first, at least those portions of the pin deck 44 that receive the pin spots 10 are cleaned with a non-residue leaving agent such as detergent and water, chlorinate solvent 008 or isopropyl alcohol and fully dried. (Block 100 in FIG. 5) Alternatively, the entire pin receiving area of the pin deck 44 could be cleaned. Alternatively, an area known to be at least as large as the standard ten-pin pin spot pattern 48 should be cleaned. The use of abrasives for cleaning the pin deck 44 is not recommended. The lane's automatic pinsetter is then cycled through several cycles and the individual pin locations are observed to ascertain the individual "pin base on spot" average as well as any variations in pin placement that may occur. (Block 102 in FIG. 5) However, no pinsetter consistently spots pins 42 in the same location. This is not an issue with the preferred pin spot 10 because the pin spot 10 has a diameter greater than the base 40 of the bowling pin 42 to ensure complete placement of each pin 42 on each pin spot 10.

It should be noted at this time that some pin decks 44 have pin locations painted thereon to facilitate the checking of pinsetter alignment. In this case, the pin spots 10 can simply be centered over the existing pin locations. However, the pin spot locating technique described above is preferred even in this case to assure alignment of the pins 44 with the pin spots 10 in operation. An alternative pin spot locating technique is to have all the bowling pins 42 placed on the pin deck 44 and then applying the no-slide pin spot 10 after removing one pin 42 at a time. Removing one pin 42 at a time and applying the pin spot 10 in the approximate location vacated by that pin base 40 will more likely enable the installer to remember the actual pin 42 location.

Next, the frictional material piece 12 of each pin spot 10 is peeled from the release backing 20 and applied directly to the pin deck 44 in the previously determined average pin placement area. (Blocks 104 and 106 in FIG. 5) After the pin spot 10 has been applied to the pin deck 44, a medium downward pressure is applied over the entire pin spot 10 with a small roller or similar tool in order to obtain the best adhesive performance (Block 108 in FIG. 5). This process is repeated until all pin spots 10 have been applied to the pin deck 44.

Figure 2:
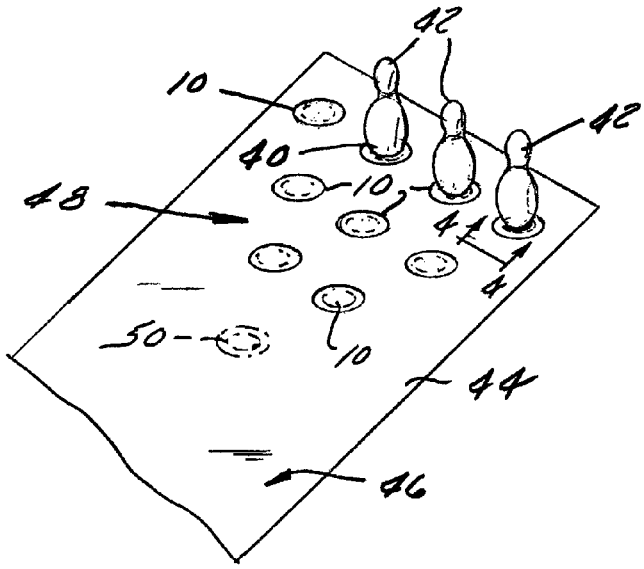
FIG. 2 is a fragmentary perspective view of a bowling lane pin deck with a plurality of the no-slide pin spots of FIG. 1 applied thereon.
Figure 5:
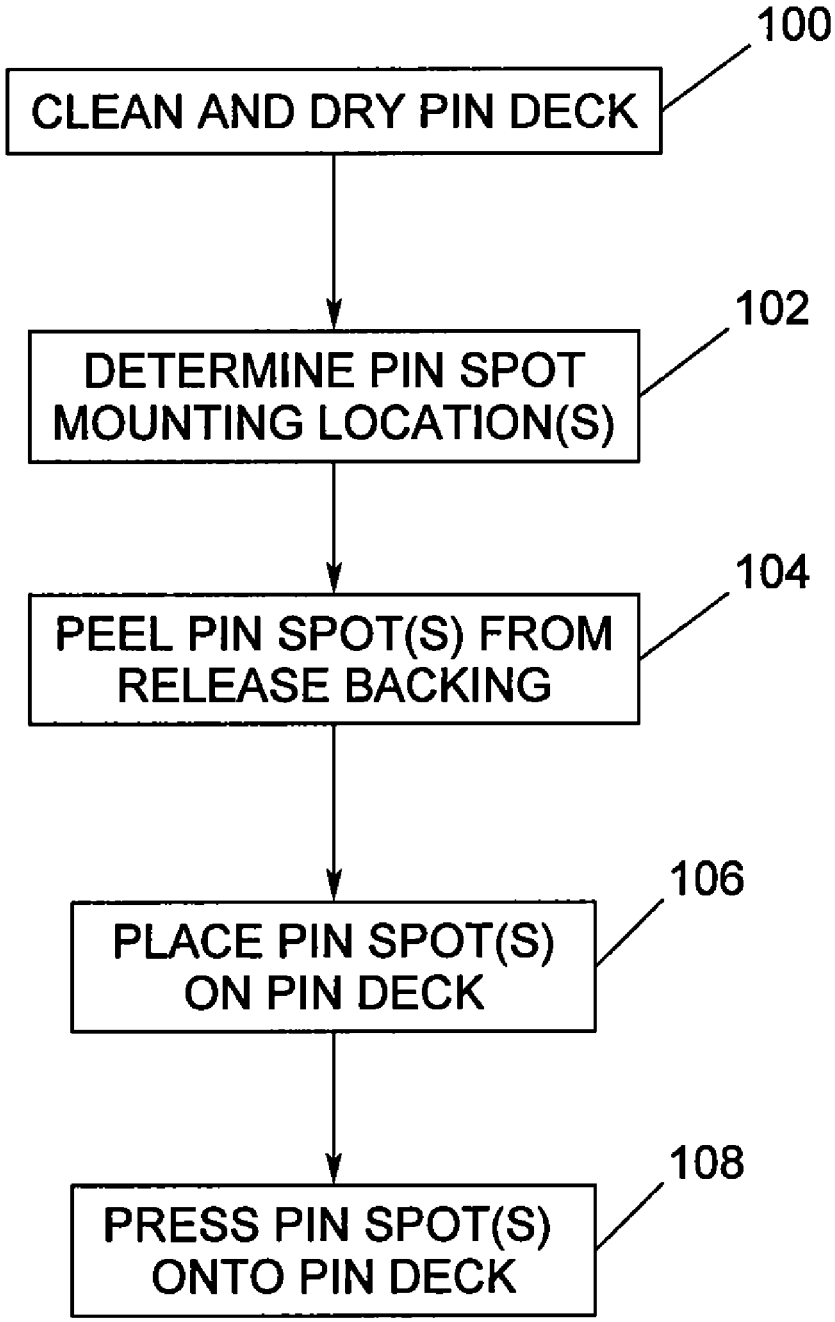
FIG. 5 is a flowchart of a process for applying the no-slide pin spots to a bowling lane pin deck.

As shown in FIGS. 2 and 4, during normal bowling play, the base 40 of a bowling pin 42 rests entirely on the no-slide pin spot 10. When the pin 42 is struck by another pin 42 or the bowling ball, the friction exerted between the pin base 40 and the top surface 14 of the pin spot 10 makes it less likely that the pin 42 will slide out-of-range or off-spot. In this context, the no-slide pin spots 10 can be said to provide a "no-slide" or "anti-skid" surface because the pin spots 10 have a much higher coefficient of friction than the surrounding pin deck 44, especially one with oils and/or conditioners. As a result of the added friction, the pins 42 are more likely to resist sliding laterally when struck and instead tip over as a result.

The pin spots 10 may gradually begin to wear after several thousand lines of bowling. Although results vary, the 3-, 5- and 9-spots are usually the first to show wear due to the maintained ball revolution of resin balls from more experienced bowlers. Pin spots 10 exhibit prolonged life with casual bowlers who typically roll a bowling ball without high revolutions, whereby the ball simply rolls across spots 10 producing little wear to the frictional material 12. As stated, not all spots 10 will wear at the same rate and only those with extreme wear need to be replaced.

When a no-slide pin spot 10 becomes worn out, it can be quickly and easily replaced by simply peeling the no-slide pin spot 10 from the pin deck 44, removing any residual adhesive 18 using a mild solvent, preparing the pin deck 44 surface, and applying a new pin spot 10 following the instructions above.

Competitive bowlers can be assured that the no-slide pin spot 10 is legal as the United States Bowling Congress (USBC) has found the preferred no-slide pin spot 10 acceptable for use in USBC-certified bowling centers.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept. The scope of still other changes to the described embodiments that fall within the present invention but that are not specifically discussed above will become apparent from the appended claims.

What is claimed is:

1. An anti-skid system for bowling pins, the system comprising:

a bowling lane pin deck having a planar upper surface;

a plurality of anti-skid pin spots secured to the planar surface of the pin deck by adhesive, each of the pin spots being formed from a sheet material having an upper surface with a dynamic coefficient of friction greater than that of the pin deck.

2. The anti-skid bowling system of claim 1, wherein the plurality of anti-skid pin spots are located in a pre-determined pattern.

3. The anti-skid bowling system of claim 2, wherein the pattern is at least one of: a standard ten-pin pattern, a standard nine-pin pattern, and a standard five-pin pattern.

4. The anti-skid bowling system of claim 2, wherein a total of nine anti-skid pin spots are applied to the pin deck.

5. The anti-skid bowling system of claim 4, wherein the nine anti-skid pin spots are applied to the pin deck in the one-pin through nine-pin spots of a standard ten-pin bowling pin pattern.

6. A method of providing an anti-skid surface for bowling pins placed on a planar upper surface of a bowling lane pin deck, the method comprising the steps of:

i. providing a plurality of frictional material pieces each having an upper, bowling pin support surface having a higher coefficient of dynamic friction than the planar pin deck surface;

ii. cleaning the planar pin deck surface with a non-residue leaving agent;

iii. applying the frictional material pieces directly to the planar pin deck surface in at least one bowling pin receiving location.

7. The method of claim 6, wherein the material pieces are arranged in a pre-determined pattern.

8. The method of claim 7, wherein the pre-determined pattern includes at least a portion of at least one of: a standard ten-pin pattern, a standard nine-pin pattern, and a standard five-pin pattern.

9. The anti-skid bowling system of claim 1, wherein each sheet is no more than approximately 1/32 inch thick.

10. The method of claim 6, wherein the frictional material piece is no more than approximately 1/32 inch thick.

* * * * *